United States Patent [19]

Riley, Jr.

[11] Patent Number: 4,721,890

[45] Date of Patent: Jan. 26, 1988

[54] POWER SUPPLY CIRCUIT FOR AN ALKALI VAPOR SPECTRAL LAMP

[75] Inventor: William J. Riley, Jr., Hamilton, Mass.

[73] Assignee: EG&G, Inc., Wellesley, Mass.

[21] Appl. No.: 389,929

[22] Filed: Jun. 18, 1982

[51] Int. Cl.[4] ..... H05B 37/02; H05B 39/04; H05B 41/36

[52] U.S. Cl. ..... 315/224; 315/248; 315/291; 315/307; 331/109; 323/312; 363/73

[58] Field of Search ..... 331/109, 117 R, 183, 331/107, 117, 183; 315/224, 248, 291, 309, 308, DIG. 5, DIG. 7; 323/311, 312; 363/73

[56] References Cited

U.S. PATENT DOCUMENTS

| | | | |
|---|---|---|---|
| 3,319,119 | 5/1967 | Rendina | 315/291 X |
| 3,573,595 | 4/1971 | Galluppi | 323/312 X |
| 3,999,100 | 12/1976 | Dendy et al. | 315/224 X |
| 4,091,339 | 5/1978 | Sugimoto et al. | 331/109 X |
| 4,245,178 | 1/1981 | Justice | 315/248 |
| 4,277,728 | 7/1981 | Stevens | 315/291 X |

OTHER PUBLICATIONS

E. W. Bell, et al., "Alkali Metal Vapor Spectral Lamps", Rev. Scit. Instr., 32, 688, (1961).

*Primary Examiner*—Saxfield Chatmon
*Attorney, Agent, or Firm*—Finnegan, Henderson, Farabow, Garrett, Dunner

[57] ABSTRACT

The output of an alkali vapor lamp for use in an optical pumping system is stabilized by use of a feedback circuit which regulates current flow from a power supply to an electronic power oscillator used to excite the alkali vapor lamp. Starting of the alkali vapor lamp is facilitated by increasing supply current to the oscillator until the alkali vapor lamp is lit.

8 Claims, 3 Drawing Figures

POWER SUPPLY CIRCUIT FOR AN ALKALI VAPOR SPECTRAL LAMP

BACKGROUND OF THE INVENTION

I. Field of the Invention

The present invention relates to the field of alkali vapor lamps and, more particularly, toward a power supply control circuit for improving the operation of electrodeless alkali vapor spectral lamps.

II. Description of the Prior Art

Small electrodeless alkali vapor lamps are used as light sources having a particular spectral content for optical pumping and atomic absorption processes. Alkali vapor lamps of this type find widespread application in optically pumped rubidium vapor frequency standards, of both the passive and active type. Such alkali vapor lamps are generally excited by the application of radio frequency energy from an electronic power oscillator.

Proper operation of a frequency standard using an alkali vapor lamp requires an electronic power oscillator or exciter that can reliably start the lamp and maintain constant lamp output under varying environmental conditions. Temperature and/or component variations in the exciter circuit can change the lamp output, both in intensity and spectral distribution. Moreover, some variations in the exciter power supply, such as low frequency ripple, can impress disturbances on the light output. Likewise, variations in the load presented to the exciter by the alkali vapor lamp can induce variations in the excitation power and thereby cause periodic fluctuations in lamp output commonly called "lamp oscillations." This effect is most often seen as audio frequency fluctuations of several percent in light output occurring in the temperature range and excitation level between the all-Rb red mode and the KrRb mixed mode for a rubidium metal vapor lamp containing krypton as a buffer gas. (Other buffer gases such as xenon may also be used.) Such variations can be sufficiently large and slow so as to cause blinking in a lamp which has poor heat dissipation capabilities. Accordingly, lamp oscillations limit the useful operating temperature range of an alkali vapor lamp.

In addition to the above-described variations in lamp output due to temperature changes, component variations, and variations in the exciter power supply, difficulties are often encountered in satisfactorily starting electrodeless alkali vapor spectral lamps using a conventional exciter power supply circuit.

Accordingly, it is an object of the present invention to provide a power supply circuit for an electrodeless alkali vapor spectral lamp which tends to stabilize the lamp output against the effects of temperature and other environmental factors affecting lamp excitation.

Another object of the present invention is to provide a power supply circuit for improving starting characteristics of an electrodeless alkali vapor spectral lamp.

A further object of the present invention is to provide a power supply circuit for reducing the effect of variations in the exciter power supply, such as low frequency ripple, on the light output of an alkali vapor lamp.

A still further object of the present invention is to provide a power supply circuit for reducing lamp oscillations in an energized electrodelss alkali vapor spectral lamp due to variations in the load presented by the lamp to an exciter.

Additional objects and advantages of the present invention will be set forth in part in the description which follows, and in part will be obvious from the description or may be learned by practice of the invention. The objects and advantages of the invention can be realized and obtained by means of the instrumentalities and combinations particularly pointed out in the appended claims.

SUMMARY OF THE INVENTION

To achieve the foregoing objects and in accordance with the purposes of the invention as embodied and broadly described herein there is provided a power supply circuit for an electrodeless alkali vapor spectral lamp comprising an a radio frequency oscillator for exciting such an alkali vapor lamp and a circuit for controlling the D.C. supply current to that oscillator. The control circuit preferably maintains a constant D.C. supply current to the oscillator after the alkali vapor lamp is lit. Moreover, to facilitate starting, the control circuit also preferably provides a greater supply current to the oscillator before the lamp is lit than after the lamp is lit.

In a more narrow sense, the power supply circuit of the present invention comprises: (a) radio frequency oscillator means for exciting an electrodelss alkali vapor spectral lamp; (b) means for sampling the D.C. supply current to the oscillator means; and (c) feedback means responsive to that sampling for controlling the D.C. supply current to the oscillator means. Preferably the feedback means regulates the supply current to effect stabilization of the output of the lamp. It is also preferable that the power supply circuit of the present invention include detector means for sensing excitation of the alkali vapor lamp, and that the feedback means includes means responsive to the detector means for supplying more current to the lamp before the light is lit than is supplied after the lamp is lit.

In a still narrower sense, there is provided a power supply circuit for an electrodeless alkali vapor spectral lamp comprising: (a) an excitation circuit which, when coupled to the lamp, forms a radio frequency oscillator capable of exciting a vapor discharge in the lamp; (b) a pair of D.C. power supply terminals for the excitation circuit; (c) a resistor coupled in series with the excitation circuit between the power supply terminals; and (d) means for regulating the D.C. current supplied to the excitation circuit by maintaining the voltage drop across the resistor in fixed relationship to a reference voltage. Preferably, the power supply circuit further includes: (a) a light detector positioned to receive light from the lamp; and (b) a threshold circuit coupled to the light detector for altering the reference voltage upon detection of light from the lamp, thereby causing more supply current to be available to the lamp before the lamp is lit then is available after the lamp is lit.

BRIEF DESCRIPTION OF THE DRAWINGS

The accompanying drawings, which are incorporated in and constitute a part of the specification, illustrate a preferred embodiment of the invention and, together with the following description, serve to explain the principles of the invention.

DESCRIPTION OF THE PREFERRED EMBODIMENT

Reference will now be made in detail to the present preferred embodiment of the invention, an example of which is illustrated in the accompanying drawings.

Figure 1:
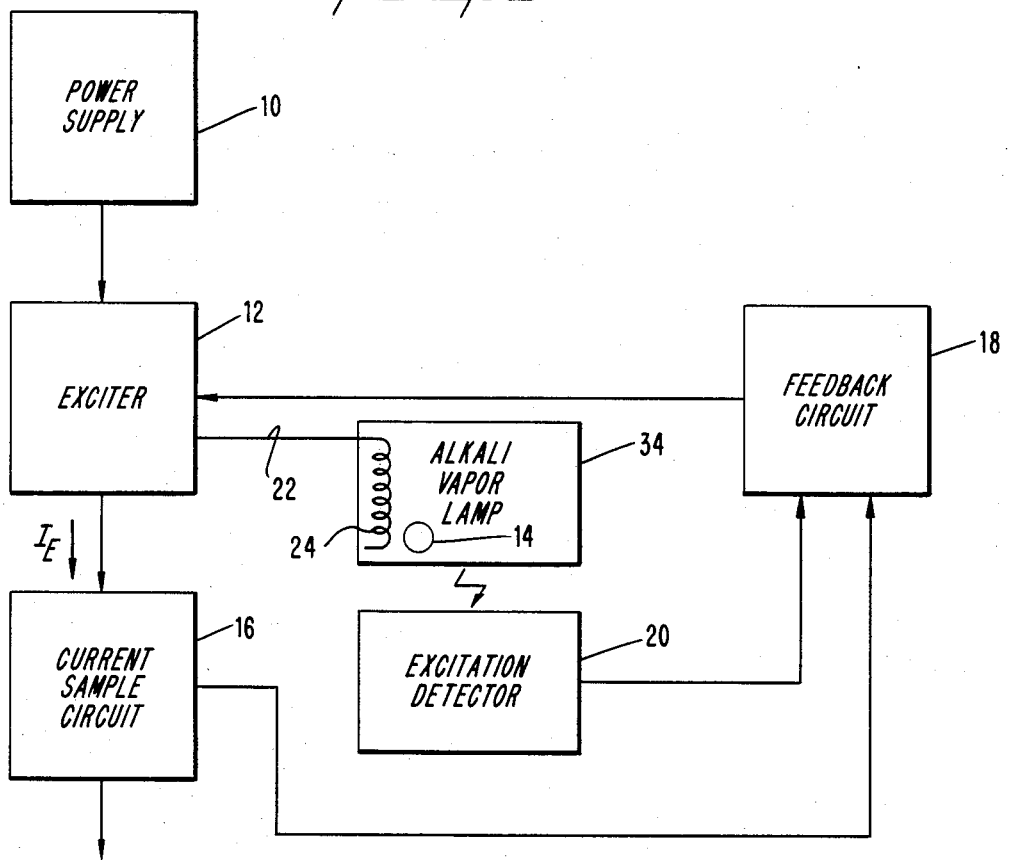
FIG. 1 is a block diagram of a circuit incorporating the teachings of the present invention.

In FIG. 1 there is illustrated a power supply 10, an exciter 12, an alkali vapor lamp assembly 34, a current sample circuit 16, a feedback circuit 18, and an excitation detector 20. Power supply 10 is coupled to exciter 12 to provide, as is typical in the prior art, a source of supply voltage for exciter 12. Exciter 12 is a power oscillator coupled by conductor 22 to alkali vapor lamp 14, which oscillator supplies radio frequency power along conductor 22 to alkali vapor lamp 14. Alkali vapor lamp 14 is preferably of the small electrodeless variety typically used as a light source having a particular spectral content for optical pumping and atomic absorption processes. Lamp assembly 34 includes an excitation mechanism illustratively shown in the form of a coil 24 in FIG. 1. Although shown as a coil in FIG. 1, this excitation mechanism may take on a capacitive form or a combination of inductance and capacitance. In any case, the excitation mechanism, in cooperation with exciter 12, forms an oscillator to effect starting and continued operation of alkali vapor lamp 14.

As discussed above, alkali vapor lamps such as lamp 14 have in the past been subject to uncontrollable variations in light output due to temperature changes, component variations, and variations in excitor power supply. To eliminate these heretofore uncontrollable variations, and in accordance with the present invention, there is provided means for controlling the supply current to the excitation oscillator for an alkali vapor lamp. As illustratively shown in FIG. 1, there is provided current sample circuit 16, feedback circuit 18, and excitation detector 20. Current sample circuit 16, in combination with feedback circuit 18, maintains a constant supply current to oscillator 12 when alkali vapor lamp 14 is lit. More specifically, current sample circuit 16 samples supply current $I_E$ from exciter 12. Feedback circuit 18 in response to this sampling controls the magnitude of supply current $I_E$. Preferably, feedback circuit 18 maintains supply current $I_E$ constant during operation of alkali vapor lamp 14. By focusing on maintaining supply current $I_E$ constant, the subject invention has been found to greatly improve the operational characteristics of lamp 14.

Moreover, the subject invention improves starting of lamp 14 by use of excitation detector 20, which may, for example, comprise a photodetector which senses when alkali vapor lamp 14 is lit and unlit. Detector 20 may, however, comprise any form of detector, which may distinguish the lit and unlit conditions of alkali vapor lamp 14. The output of detector 20 is coupled to an input of feedback circuit 18 and is used by feedback circuit 18 to control the magnitude of supply current $I_E$ of exciter 12 by increasing the magnitude of supply current $I_E$ when alkali vapor lamp 14 is unlit beyond the magnitude of supply current $I_E$ which is supplied after alkali vapor lamp 14 is lit. In this manner, as is explained in more detail below, the present invention greatly facilitates starting of lamp 14.

Figure 2:
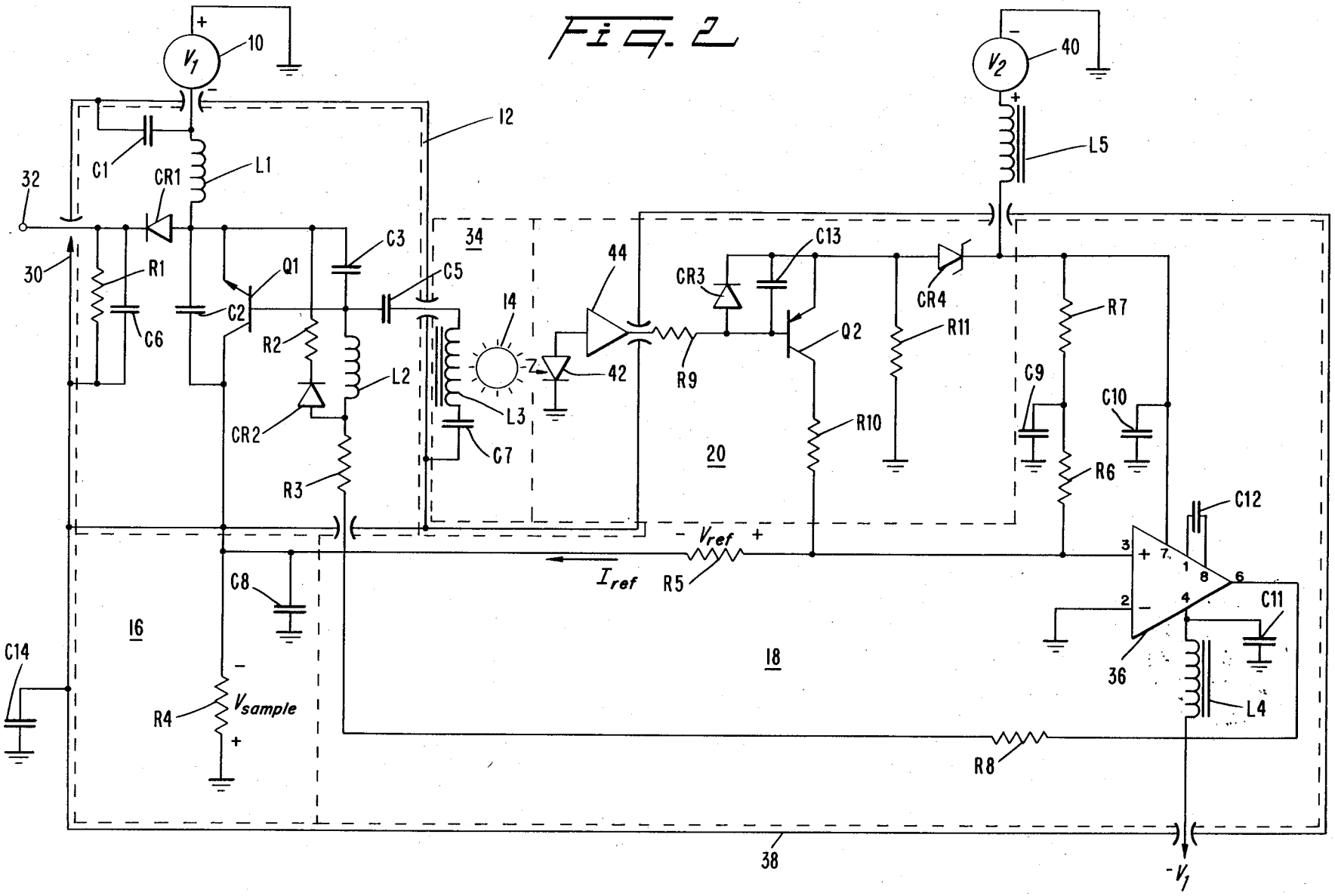
FIG. 2 is a schematic diagram of a particular circuit incorporating the teachings of the present invention.

FIG. 2 provides a particular and illustrative embodiment of one form of the circuit illustrated in FIG. 1. More specifically, in FIG. 2 a power supply 10 is illustrated as providing a negative voltage supply to exciter 12, for example, on the order of negative 15 volts. Exciter 12 is shown in FIG. 2 as comprising a power oscillator including transistor Q1, inductors L1 and L2; capacitors C1, C2, C3, C5 and C6; resistors R1, R2, and R3; diodes CR1 and CR2; and a metallic case 30 in which the above-named components are maintained. The negative output terminal of power supply 10 is coupled through inductor L1 to the emitter-collector path of transistor Q1, with the emitter of transistor Q1 connected to one end of inductor L1 and the collector of transistor Q1 connected to case 30. Capacitor C2 is connected across the emitter and collector of transistor Q1 while capacitor C1 bypasses the negative output of power supply 10 to the case 30. Capacitor C3 is connected across the emitter-base path of transistor Q1. Diode CR1 is connected between the emitter of transistor Q1 and monitoring terminal 32 while capacitor C6 and resistor R1 are connected in parallel between terminal 32 and the case 30. The CR1, R1 and C6 network forms a rf detector to monitor the oscillator circuit.

The base of transistor Q1 is coupled by capacitor C5 to alkali vapor lamp 14 and is coupled by the series combination of inductor L2 and resistor R3 to an input of feedback circuit 18. The junction of inductor L2 and resistor R3 is connected by the series combination of diode CR2 and resistor R2 to the emitter of Q1. Resistor R2 and diode CR2 serve as part of the bias network of transistor Q1 to establish a relatively low bias source resistance.

In FIG. 2 there is illustrated an alkali vapor lamp assembly 34 comprising a lamp 14, an inductor L3, and a capacitor C7. As is well-known in the art, inductor L3 and capacitor C7 represent an electrodeless excitation mechanism for lamp 14. Inductor L3 and capacitor C7 are shown connected in series between case 30 at one end and the base of emitter Q1 through capacitor C5 at the other end. Accordingly, capacitors C2, C3, C5 and C7 in combination with inductor L3 and transistor Q1 form an oscillator circuit which is supplied through inductor L1 with a DC supply voltage from power supply 10.

A DC return for exciter 12 is illustrated in FIG. 2 as comprising current sample circuit 16 which includes a resistor R4 connected between case 30 of exciter 12 and ground, and a by-pass capacitor C8 connected in parallel to resistor R4. Accordingly, exciter supply current $I_E$ flows from ground through resistor R4 into exciter 12 by operation of negative power supply 10. Therefore, the voltage drop across resister R4 provides an indication or sampling of the magnitude of exciter supply current $I_E$. This sampling of supply current $I_E$ is utilized by feedback circuit 18 to control the magnitude of base current supplied to exciter 12 through resistor R3 and inductor L2.

More specifically, feedback circuit 18 is illustrated in FIG. 2 as including resistors R5, R6, R7, and R8; bypass capacitors C9, C10, C11, and C14 compensation capacitor C12; inductor L4; and operational amplifier 36, all contained within a metallic regulator section case 38. Operational amplifier 36 has two inputs, one shown in FIG. 2 connected to ground and the other shown connected to resistor R4 by resistor R5. Operational amplifier 36 is provided a positive voltage supply at terminal 7 by power supply 40 through inductor L5, and is provided a negative voltage at terminal 4 from power supply 10 through inductor L4. Compensation capacitor C12 is connected between terminals 1 and 8 of operational amplifier 36, while a by-pass capacitor C11 is connected between terminal 4 and ground.

The output of operational amplifier 36 is coupled through resistor R8 to resistor R3 of exciter 12 to provide base current to transistor Q1 of exciter 12. Moreover, as further shown in FIG. 2, resistors R6 and R7 are connected in series between inductor L5 and the non-inverting input terminal of operational amplifier 36. Bypass capacitor C9 AC couples the common junction point of resistors R6 and R7 to ground, while bypass capacitor C14 AC couples case 38 to ground. Moreover, inductors L4 and L5 and capacitors C9, C10 and C11 serve to filter power supply ripple to feedback circuit 18 and excitation detector 20, while inductor L1 in conjunction with capacitor C1 serves a similar function in exciter 12.

In operation, operational amplifier 36 will tend to supply sufficient current to exciter circuit 12 through resistor R8 to hold the voltage drop across resistor R4 at approximately the same level as the voltage drop across resistor R5. With resistor R5 chosen to be substantially larger than resistor R4, the great majority of exciter supply current $I_E$ passes across R4, causing a proportional drop across resistor R4. The voltage across resistor R5 is, therefore, primarily dictated by the current established through resistors R6 and R7. Accordingly, the resistors R6 and R7 effectively establish the reference voltage across resistor R5, and operational amplifier 36 operates to supply sufficient current to exciter 12 in order to maintain the sample voltage drop across resistor R4 in a fixed relationship to the reference voltage established by resistors R6 and R7 across resistor R5, thereby maintaining exciter supply current $I_E$ constant during operation of alkali vapor lamp 14.

Figure 3:
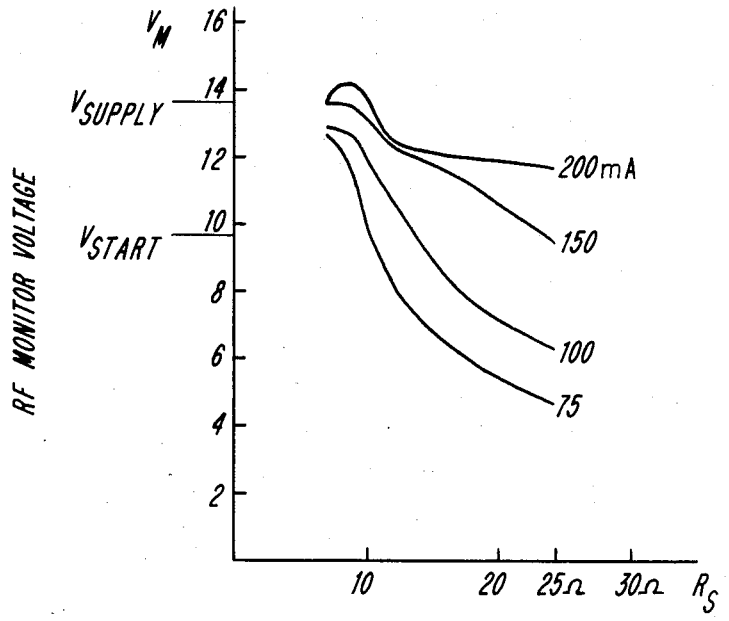
FIG. 3 is a graph showing the relationship between exciter voltage, current, and load.

Capacitor C6, resistor R1, and diode CR1 along with terminal 32 of FIG. 1, provide a monitoring circuit which may be added to exciter 12 to allow measurement of exciter RF output voltage $V_M$ at output terminal 32. As shown in FIG. 3, $V_M$ can be measured under a range of load conditions using resistors as dummy loads in series with the lamp coil. The results of such an investigation are illustrated in the graph of FIG. 3. An effective nominal resistance $R_s$ of an unlit lamp was determined by the inventor to be typically on the order of 25 ohms. From FIG. 3 it may be seen that exciter 12 is operating very unsaturated when loaded with 25 ohms at a typical 100 ma current. Furthermore, FIG. 3 illustrates that an increase in supply current (rather than supply voltage) from 100 ma to 200 ma would about double the RF output voltage. Lamp starting takes place when sufficient RF voltage appears across inductor L3. Accordingly, increasing exciter supply current $I_E$ facilitates starting of lamp 12. Moreover, increased exciter current $I_E$ not only raises the RF voltage appearing across coil L3 but also rapidly redistributes the condensed alkali metal within lamp 14 by RF induction heating. This redistribution lowers the loading on exciter 12 and further raises the RF voltage on coil L3.

Accordingly, excitation detector 20 in combination with feedback circuit 18, provides more supply current $I_E$ to exciter 12 when lamp 14 is unlit than when lamp 14 is lit. More specifically there is illustrated in FIG. 2 an illustrative form of excitation detector 20 including a photodetector 42 and an amplifier 44 located outside case 38; and including resistors R9, R10, R11; diode CR3 and zener diode CR4; capacitor C13; and transistor Q2 located within case 38. Photodetector 42 is coupled in series with amplifier 44 and resistor R9 to the base of transistor Q2.

Photodetector 42 may, when alkali lamp 14 is used in connection with an atomic clock, be the same detector as that which is used to detect changes in light in a standard prior art optical-physics package. The emitter of transistor Q2 is coupled to power supply 40 by zener diode CR4 and inductor L5. The collector of transistor Q2 is coupled through resistor R10 to the non-inverting input of operation amplifier 36. The common junction of emitter Q2 and the anode of zener diode CR4 is coupled to ground through resistor R11, while the parallel combination of diode CR3 and capacitor C13 couples the base of transistor Q2 to the emitter of transistor Q2.

In operation, excitation detector 20 supplies an additional reference current through resistor R5 upon detection that alkali vapor lamp 14 is unlit and removes this additional current upon detection that alkali vapor lamp 14 has been lit. More specifically, the output of photodetector 42 is supplied by amplifier 44 to the base of transistor Q2. In the absence of light from lamp 14, amplifier 44 is designed to supply a low output voltage to turn transistor Q2 on, thereby providing additional current to resistor R5 through resistor R10. This additional current increases the effective voltage across resistor R5, and thereby increases the reference voltage against which the voltage drop across resistor R4 is measured by operational amplifier 36. Upon receipt of light from lamp 14, photodetector 42 operates to raise the output voltage from amplifier 44, thereby turning off transistor Q2 and removing any additional current supplied through resistor R10 to resistor R5.

Diode CR3 operates to protect the base-emitter junction of transistor Q2 from breakdown, and capacitor C3 operates as a low pass filter to provide a narrow bandwidth for excitation detector 20. Zener diode CR4 provides, in conjunction with resistor R11, a sharp threshold voltage for transistor Q2.

Accordingly, current supplied by exciter 12 to vapor lamp 14 through inductor L3 and capacitor C7 is regulated by comparing the voltage drop across resistor R4 against the voltage drop across resistor R5 by means of operational amplifier 36. Operational amplifier 36 operates to adjust current to the base of transistor of Q1 to exciter 12 through resistor R8 to maintain a constant supply current $I_E$ and, thereby, to maintain a constant current to alkali vapor lamp 14 once lamp 14 is lit. Thus, this arrangement in effect forms a negative feedback loop. However, before lamp 14 is lit, additional current is supplied to resistor R5 by transistor Q2, increasing the voltage drop across to exciter 12 to resistor R5 and thereby increasing the supply current $I_E$ to facilitate excitation of lamp 14.

Besides loop stability, certain conditions should be met for best performance of the present invention. Specifically: (a) current sampling resistor R4, reference resistor R5 and reference supply 40 and resistors R6 and R7 should have adequate long-term and environmental stability; (b) feedback circuit 18 should have sufficient close-loop bandwidth to provide adequate AC ripple rejection; (c) feedback circuit 18 should be adequately isolated and shielded by case 38 from exciter 12 and from the RF field around lamp 14; and (d) exciter 12 should be capable of delivering additional power for starting lamp 14 when supplied with additional bias current from operational amplifier 36 through resistor R8.

Accordingly, transistor Q1 serves not only to provide a basic power oscillator for lamp 14 but also serves as the power element to regulate exciter supply current $I_E$. The negative feedback loop is preferably operated at a fairly wide bandwidth.

Suitable operation may, for example, be obtained using the following values for the components illustrated in FIG. 2.

| Resistor | | Capacitor | | Inductor | | Semiconductor Devices | |
|---|---|---|---|---|---|---|---|
| R1 | 100K ohms | C1 | .02 uF | L1 | 2.2 uH | CR 1 | 1N5711 |
| R2 | 100 ohms | C2 | 27 pF | L2 | 2.2 uH | CR 2 | 1N3600 |
| R3 | 2K ohms | C3 | 150 pF | L3 | 0.7 uH | CR 3 | 1N3600 |
| R4 | 1 ohm | C5 | 220 pF | L4 | 4.7 uH | CR 4 | 1N5530B |
| R5 | 1K ohms | C6 | .001 uF | L5 | 4.7 uH | | 10 v. |
| R6 | 50K ohms | C7 | 3.6 pF | | | Q1 | MSC 82019 |
| R7 | 100K ohms | C8 | 1.0 uF | | | Q2 | 2N2907A |
| R8 | 100 ohms | C9 | 1.0 uF | | | U1 | LM101A |
| R9 | 100K ohms | C10 | 1.0 uF | | | | |
| R10 | 40.2K ohms | C11 | 1.0 uF | | | | |
| R11 | 4.7K ohms | C12 | 30 uF | | | | |
| | | C13 | 1.0 uF | | | | |
| | | C14 | .01 uF | | | | |

Performance of a frequency standard using the circuitry of the present invention is insensitive to environmental conditions affecting the lamp exciter by maintaining a constant exciter supply current. Similarly, lamp output is made insensitive to low frequency ripple on the exciter voltage supply by maintaining a constant exciter supply current. Moreover, current regulation reduces or prevents "lamp oscillation" by stabilizing exciter power against variations in lamp load. Still further, lamp starting is facilitated with the use of the same regulator circuit that maintains constant exciter supply current.

While a particular embodiment of the present invention has been shown and described, it will of course be obvious to one skilled in the art that certain advantages and modification may be effected without departing from the spirit of the invention, and it is intended that the scope of the invention be determined not by the foregoing illustrative example of the invention but rather by the scope of the appended claims.

What is claimed is:

1. A power supply circuit for an electrodeless alkali vapor spectral lamp comprising:

a. radio frequency oscillator means for exciting an electrodeless alkali vapor spectral lamp;

b. means for sampling D.C. supply current to said oscillator means;

c. feedback means responsive to said means for sampling for regulating said D.C. supply current to said oscillator means by controlling the operation of said oscillator means to thereby effect stabilization of the output of said lamp;

d. detector means for sensing excitation of said lamp, and wherein said feedback means includes means responsive to said detector means for permitting more current to pass through said oscillator means before said lamp is lit than after said lamp is lit.

2. The circuit of claim 1 wherein said detector means is a light detector.

3. The circuit of claim 1 wherein said means for sampling establishes a sample D.C. voltage proportional to said supply current.

4. The circuit of claim 3 wherein said feedback means includes means for comparing said sample voltage to a reference voltage.

5. The circuit of claim 4 further including detector means for varying said reference voltage upon lighting of said lamp, causing said feedback means to permit more current to pass through said oscillator means before said lamp is lit than after said lamp is lit.

6. A power supply circuit for an electrodeless alkali vapor spectral lamp comprising:

a. an excitation circuit which, when coupled to said lamp, forms a radio frequency oscillator capable of exciting a vapor discharge in said lamp;

b. a pair of power supply terminals for said excitation circuit;

c. a resistor coupled in series with said excitation circuit between said power supply terminals;

d. means for regulating the current supply to said excitation circuit by controlling the operation of said excitation circuit to maintain the D.C. voltage drop across said resistor in fixed relation to a reference voltage;

e. a light detector positioned to receive light from said lamp; and f. a threshold circuit coupled with said light detector for altering said reference voltage upon detection of light from said lamp, thereby causing said means for regulating to permit more current to pass through said excitation means before said lamp is lit than after said lamp is lit.

7. The circuit of claim 6 wherein said excitation circuit further includes a transistor having a primary current path coupled in series with said resistor and further having a control electrode; and wherein said means for regulating includes means for generating a feedback signal in response to said D.C. voltage drop across said resistor and means for coupling said feedback signal to said control electrode of said transistor.

8. A power supply circuit for an electrodeless alkali vapor spectral lamp comprising:

a. radio frequency oscillator means for exciting an electrodeless alkali vapor spectral lamp;

b. means for sampling D.C. supply current to said oscillator means to establish a sample D.C. voltage proportional to said D.C. supply current; and c. feedback means responsive to said means for sampling and including means for comparing said sample voltage to a reference voltage, for regulating said D.C. supply current to said oscillator means by controlling the operation of said oscillator means to stabilize the output of said lamp.

* * * * *